United States Patent [19]

Bower

[11] Patent Number: 4,767,074

[45] Date of Patent: Aug. 30, 1988

[54] DISPENSING HOLDER

[76] Inventor: Glenister B. Bower, 12 Mills Street, Durbanville, South Africa, 7550

[21] Appl. No.: 776,609

[22] Filed: Sep. 16, 1985

[30] Foreign Application Priority Data

Sep. 17, 1984 [ZA] South Africa ..... 84/7291

[51] Int. Cl.[4] ..... B65H 19/00

[52] U.S. Cl. ..... 242/55.2; 242/55.3

[58] Field of Search ..... 242/55.2, 68.3, 129.5, 242/129.7, 129.71, 130, 134, 141

[56] References Cited

U.S. PATENT DOCUMENTS

| | | | |
|---|---|---|---|
| 1,442,177 | 1/1923 | Proulx | 242/129.7 |
| 2,632,605 | 3/1953 | Lee | 242/55.2 |
| 2,707,595 | 5/1955 | Brown | 242/55.2 |
| 4,235,389 | 11/1980 | Ness | 242/55.2 |
| 4,273,299 | 6/1981 | Ness | 242/55.2 |
| 4,557,011 | 12/1985 | Sartori | 242/55.2 |

*Primary Examiner*—Stuart S. Levy
*Assistant Examiner*—Katherine Matecki
*Attorney, Agent, or Firm*—Browdy and Neimark

[57] ABSTRACT

A dispensing holder, for rotatably holding a toilet (or other) roll having an open-ended tubular core, comprises a base 14, a pair of roll supports 16 projecting cantilever fashion from the base, and, at the free end of each of the roll supports, a nose piece 18. Each nose piece comprises an elastomeric disc 32 and a stop element 34 abutting against the disc. The diameter of the elastomeric disc 32 is slightly greater than the inside diameter of the core, whereas the diameter of the stop element 34 is slightly less than the inside diameter of the core. This will permit a toilet roll to be pushed over and beyond the nose piece onto the roll support, and will prevent subsequent withdrawal of the roll from the roll support.

1 Claim, 1 Drawing Sheet

DISPENSING HOLDER

FIELD OF THE INVENTION

This invention relates to a dispensing holder, for rotatably holding a roll of sheet material having an open-ended tubular core.

BACKGROUND OF THE INVENTION

More particularly, the invention relates to a dispensing holder for holding a roll of toilet paper. The theft of toilet rolls, particularly from public conveniences, has always been a problem. Many solutions have heretofore been proposed but none of these has ever been entirely satisfactory. It is an object of the present invention to provide a simple yet effective dispensing holder for preventing or at least discouraging such theft.

SUMMARY OF THE INVENTION

According to the invention there is provided a dispensing holder for holding a roll of sheet material having an open-ended tubular core, the holder comprising:

a base;

an elongate roll support projecting cantilever fashion from the base, the roll support being such as to be able to extend through said core from one end thereof to the other and thus to support the roll; and a nose piece at the free end of the roll support, the nose piece comprising a transversely extending, resiliently deflectable retaining element arranged to permit the roll to be pushed over and beyond the nose piece onto the roll support and to resist withdrawal of the roll from the roll support.

The retaining element may be in the form of an elastomeric disc whose diameter, when in an unflexed condition, is slightly greater than the inside diameter of said core, the elastomeric disc being mounted such that a peripheral portion thereof is resiliently deflectable from the unflexed condition in a direction towards the base, and the nose piece further comprising a stop element which, by abutting against that side of the elastomeric disc facing away from the base, is effective to prevent deflection of said portion from the unflexed condition in a direction away from the base, the transverse extent of the stop element being slightly less than the inside diameter of the core.

BRIEF DESCRIPTION OF THE DRAWINGS

The invention will now be described in more detail, by way of example, with reference to the accompanying drawings.

In the drawings.

DETAILED DESCRIPTION OF PREFERRED EMBODIMENT

Figure 1:
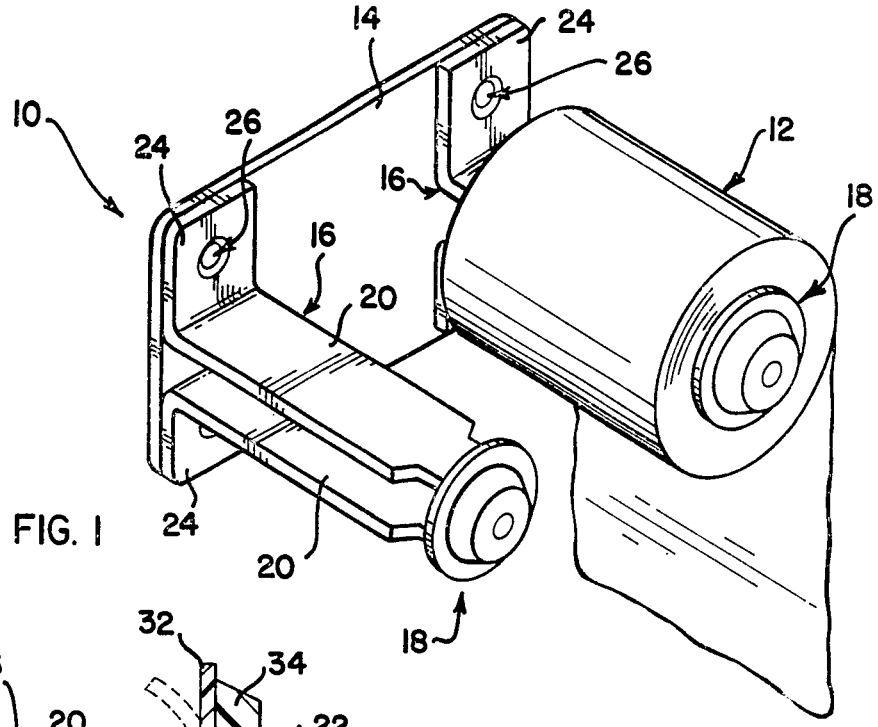
FIG. 1 is a three-dimensional view of a toilet roll dispensing holder in accordance with the invention, a toilet roll being shown supported by the holder.

Referring now to the drawings in more detail, reference numeral 10 in FIG. 1 generally indicates a toilet roll dispensing holder, and reference numeral 12 a toilet roll supported by the holder. Although only one toilet roll is shown, the holder is adapted to support two such rolls.

The holder 10 comprises a base 14, a pair of elongate roll supports 16 each projecting cantilever fashion from the base, and, at the end of each of the roll supports, a nose piece 18.

Although the roll supports 16 could be of any convenient construction, they consist, in the illustrated embodiment, of a U-shaped strip having a pair of parallel legs 20, an end piece 22 joining the legs at the free end of the roll support, and a bracket 24 at the base end of each of the legs. The strip is secured to the base (e.g. by spot welding) via the brackets 24. The base is provided with a number of countersunk holes 26 (which extend also through the brackets 24) whereby the holder can be secured to the wall of a W.C.

Figure 2:
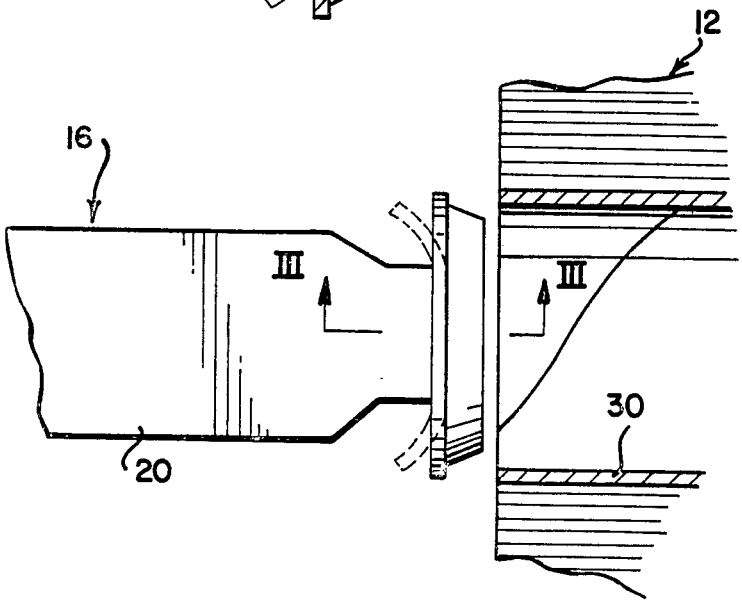
FIG. 2 is a plan view of part of the holder, part of the toilet roll being shown in section.

As will be seen in FIG. 2, the toilet roll 12 has an open-ended tubular core 30. The length, width, and spacing of the legs 20 of each of the roll supports 16 are such that the roll support is able to extend with clearance through the core 30 from one end thereof to the other and thus rotatably to support the roll.

Figure 3:
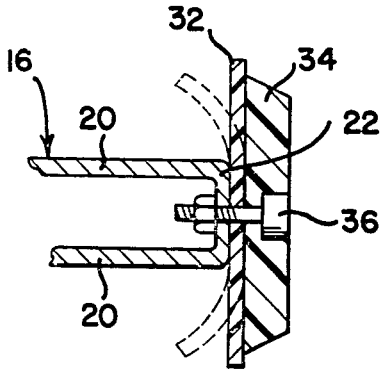
FIG. 3 is a section of part of the holder, taken on line III—III in FIG. 2.

Each nose piece 18 comprises a disc 32 of elastomeric material, and a stop element 34 of a relatively rigid material abutting against that side of the elastomeric disc 32 which faces away from the base 14. The diameter of the disc 32 is slightly greater than the inside diameter of the core 30. As will be seen in FIGS. 2 and 3, the stop element 34 is of frusto-conical or tapered shape, tapering down in a direction away from the base 14. Its maximum diameter (i.e. adjacent the elastomeric disc 32) is slightly less than the inside diameter of the core 30. The elastomeric disc 32 and the stop element 34 are together secured to the end piece 22 by means of a pilfer-proof fastener such as an Allen screw 36. Alternatively, they could be secured to the end piece 22 by means of a rivet.

The strip forming the roll support 16 narrows down in the region of the end piece 22 and part of each of the legs 20 adjacent the end piece 22, so as to reduce the area of contact between the roll support and the elastomeric disc 32 and thus to permit a peripheral portion of the disc to be deflected towards the base 14.

To mount a toilet roll 12 on the holder 10, the roll is simply pushed over and beyond one of the nose pieces 18 onto the corresponding roll support 16. When this is done the core 30 resiliently deflects a periperal portion of the elastomeric disc 30 from the unflexed condition shown in solid lines in FIGS. 2 and 3 to the flexed condition shown in dotted lines in FIGS. 2 and 3. This has the effect of reducing the radial extent of the elastomeric disc 32 so that the core 30 can pass over the nose piece onto the corresponding roll support 16. Once the toilet roll 12 has been pushed home onto the roll support 16, the elastomeric disc 32 reverts to the unflexed condition. The stop element 34 is effective to prevent deflection of the elastomeric disc 32 in the opposite direction (i.e. from the unflexed condition away from the base 14). This will make it extremely difficult, if not impossible, for the toilet roll 12 to be withdrawn from the roll support. When the roll 12 is empty and thus only the core 30 is left on the roll support 16, the core 30 can readily be removed by cutting or tearing it, whereupon a new toilet roll can be mounted on the roll support.

I claim:

1. A dispensing holder for holding a roll of sheet material, which roll has an open-ended tubular core having an inside diameter, the holder comprising:

a base;

an elongate roll support projecting cantilever fashion from the base, the roll support having a distal end remote from the base and being such as to be able to extend through said core from one end of the core to the other and thus to support the roll;

an elastomeric disk mounted on said roll support approximately at said distal end, the diameter of which disc, when in an unflexed condition, being slightly greater than the inside diameter of said core, and the elastomeric disc being mounted such that it is resiliently deflectable from the unflexed condition in a direction towards the base to enable said roll to be fitted onto the roll support; and a stop element mounted on said roll support approximately at said distal end which stop element, by abutting against a side of the elastomeric disc facing away from the base, is effective to resist deflection of the disc from the unflexed condition in a direction away from the base, the transverse extent of the stop element being slightly less than the inside diameter of the core.

* * * * *